United States Patent [19]

Gershnow

[11] 4,407,595

[45] Oct. 4, 1983

[54] COLOR PRINTING APPARATUS

[75] Inventor: Abraham H. Gershnow, Merrimack, N.H.

[73] Assignee: Digital Equipment Corporation, Maynard, Mass.

[21] Appl. No.: 298,087

[22] Filed: Aug. 31, 1981

[51] Int. Cl.[3] ..... B41J 35/14; B41J 35/16

[52] U.S. Cl. ..... 400/212; 400/216.1; 400/240.4

[58] Field of Search ..... 400/212, 216, 216.1, 400/240.4

[56] References Cited

U.S. PATENT DOCUMENTS 3,977,320 8/1976 Lupkas et al. ..... 400/155 X
4,280,767 7/1981 Heath ..... 400/216.2

FOREIGN PATENT DOCUMENTS 2306836 11/1976 France ..... 400/216.1

*Primary Examiner*—Paul T. Sewell
*Attorney, Agent, or Firm*—Cesari and McKenna

[57] ABSTRACT

Apparatus for color printing for installation in a printer having a platen, a carriage, a printing head mounted on the carriage, a mechanism for moving the carriage along parallel to the platen and a control for actuating the print head so that the print head can print on a printing medium engaged on the platen employs a guide for guiding a segment color-banded ink ribbon between the printing means and the platen parallel to the platen so that, when actuated, the print head prints indicia in a color corresponding to the ribbon segment color band located opposite the print head. The apparatus also includes a rigid beam pivotally connected to the guide, the pivotal connection being displaced along the beam from the beam transverse centerline. First and second pivots are connected adjacent to opposite ends of the beam. There is also a first lifter for lifting the first pivot to at least one elevation so that the beam is swung up about the second pivot thereby raising the ribbon guide a first selected distance above a reference position and a second lifter for lifting the second pivot to at least one elevation so that the beam is swung up about the first pivot thereby raising the guide a second distance above the reference position, said beam and guide being lifted to a third selected position above the reference position when both pivots are lifted.

7 Claims, 9 Drawing Figures

COLOR PRINTING APPARATUS

This invention relates to a printer. It relates more especially to an electronic printer which incorporates color printing apparatus so that the printer can print in a plurality of colors.

BACKGROUND OF THE INVENTION

Typically, a printer prints in only one color, usually black. In certain applications, however, it is desirable to be able to print in a plurality of colors. For example, it may be desired to highlight particular information in the text being printed by displaying it in a different color, i.e. red. Also, since printers are often used to generate graphs, it is desirable to be able to readily distinguish different values or ranges of values in the graphs by using different colors for the different ranges.

Printing devices capable of printing in different colors have been available for some time. For example, the standard typewriter usually includes provision for typing in two different colors using an ink ribbon having upper and lower horizontal bands of different colors, e.g. red and black. A ribbon raising and lowering mechanism is used to raise the ribbon from its rest position selectively to either of two elevations depending upon whether the next character is to be printed in red or in black.

There also exist in the art high speed printers such as line printers and dot matrix printers capable of forming characters in a plurality of different colors. These prior printers also employ ink ribbons composed of upper and lower horizontal bands of different colors. In such prior printers, the ink ribbon is also shifted vertically relative to the print elements or print head between different vertical positions associated with the different color printing modes. Examples of such prior apparatus are disclosed in U.S. Pat. Nos. 3,583,315; 4,073,371 and 4,084,503. However, the apparatus disclosed there can only position the ink ribbon for selection between two different colors. Therefore, those printers would be unsuitable for producing texts and graphs requiring several different colors to differentiate the different categories of data in the text and graphs.

While it might appear to be obvious from the prior art that a wider selection of colors could be obtained simply by employing an ink ribbon composed of several different color bands and a printer mechanism for positioning the ribbon relative to the print head to permit selection of the different colors on the ribbon, it is not at all obvious how that can be accomplished in a reasonably simple and economical manner. That is, as evidenced from the above referenced art, the mechanisms used to position the ink ribbon to permit two color printing are already quite complex and expensive employing, as they do, numerous links, springs, toggles, pawls and electromechanical parts. It is not at all apparent, then, how any of those printers could be modified to enable it to print in even three different colors, let alone four or more colors.

With specific reference to the matrix printer disclosed in the above-mentioned U.S. Pat. No. 4,073,371, that apparatus has other distinct disadvantages, namely, the ribbon shifting mechanism produces ribbon travel problems and requires a cam which places an extra load on the carriage which inhibits its speedy movement from one printing position to the next. Also that mechanism requires a long radius arm to the ribbon shifting member and is quite bulky. Other prior apparatus rely on DC servos to achieve color selection and their response is quite slow.

SUMMARY OF THE INVENTION

Accordingly, the present invention aims to provide an improved printer capable of printing in a plurality of different colors.

A further object of the invention is to provide a printer of the dot-matrix type which can print in several colors at high speed.

A further object of the invention is to provide such a color printer which requires only a relatively small number of extra parts over its parts complement for single color printing in order to print two or more colors.

A further object of the invention is to provide a printer such as this which can accurately position an ink ribbon composed of several color bands so that there is no color overlap between bands during printing.

Still another object of the invention is to provide color printing apparatus which can be installed on or retrofitted to existing single color printers to adapt those printer for plural-color printing.

A further object is to provide such apparatus which accomplishes color selection quickly and accurately.

Yet another object of the invention is to provide such apparatus which is relatively easy and inexpensive to make and install.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, the present apparatus for color printing employs an ink ribbon having a plurality of lengthwise parallel bands of different color. As with other color printers of this general type, means are provided for selectively positioning a working segment of each color band in the print area directly opposite the print head or other printing element. Resultantly, when the print head or element is next actuated, the printed indicia will be of the selected color. Only the working ribbon segment in the print area may be so positioned as disclosed, for example, in the first two patents mentioned above. Alternatively, the entire ribbon supply may be shifted in order to properly position the working ribbon segment in the print area, as disclosed in the last above-mentioned patent.

In this application, we describe apparatus of the latter type incorporating a multi-color ink ribbon which is contained in a cartridge that is shiftable in its entirety in order to position the ribbon for printing in different colors. It should be understood, however, that the invention is equally applicable to printing apparatus wherein only the working segment of the ribbon in the print area is so shifted. Also, the printer that we describe is a dot matrix impact printer. However, the invention could be applied equally well to other types of printers such as daisy wheel printers, conventional typewriters employing character-forming strikers and line printers utilizing character drums.

In the present printer, the printing medium or paper is engaged around a platen and the print head is mounted on a carriage which is movable parallel to the platen. A support for the ribbon cartridge is hingedly mounted to the carriage at a location distal to the platen. The cartridge itself is located on the support so that a small working segment of ribbon projecting from the leading edge of the cartridge is positioned between the print head and the platen.

During operation of the printer, the carriage is moved along the platen, while selected combinations of print wires are driven by solenoids against the ribbon segment and the paper engaged on the platen to form a line of dot-matrix characters. A typical printer employs a column of seven such wires which enable it to form any selected character in a seven by five dot field or matrix. A spindle rotatively mounted to the support projects into a take-up ribbon spool located inside the cartridge. Also, provision is made for rotating the spindle continuously or incrementally as the carriage moves along the platen to ensure that a fresh ink ribbon segment is presented to the print head at all times.

Means are provided to swing or tilt the cartridge support on its hinge to the carriage so as to raise and lower the leading edge of the ribbon cartridge and the ribbon segment exposed thereat to a number of positions corresponding to the number of different color bands on the ribbon. For this, a free edge of the support is connected by a link to a binary actuating mechanism situated below the support. That actuating mechanism comprises a pair of spaced-apart rotary actuators whose armatures terminate in oppositely-directed crank arms extending at right angles to the armatures. The free ends of the arms are, in turn, slidably/pivotally connected to the opposite ends of a straight beam. The free end of the link extending from the support is connected by a pivot to the beam at a location thereon such that the distance between the link pivot to the pivotal connection of the beam to one crank arm is approximately twice the distance between the link pivot and the beam connection to the other crank arm. For convenience, we will refer to the actuator connected to the end of the beam further away from the link pivot as the first actuator, while the other actuator will be referred to as the second actuator.

When the first actuator is energized, its armature is rotated through a fixed angle, thereby rotating the attached crank arm through the same angle. This swings one end of the beam upwards about its pivotal connection to the other actuator crank arm. Likewise, when the second actuator is energized, its armature and the attached crank arm are swung through the same fixed angle. Resultantly, the attached end of the beam is swung upwards about its pivotal connection to the first actuator crank arm. Finally, when both actuators are energized at the same time, both of their crank arms swing upwards so that the entire beam is raised upwards.

In accordance with well-known physical principles, the distance which the link pivot and, therefore, the link as a whole and the cartridge support to which it is connected will move when the beam is moved is proportional to the product of the lever arm between the link and the beam pivot and the angle (in radians) through which the beam is swung. As noted previously, the distance beween the link pivot and the second actuator crank arm is only half the distance between that pivot and the first actuator crank arm. Therefore, when the second actuator is energized, the link pivot (and therefore the cartridge support) is raised up twice as far as it is when the first actuator is activated. Further, the crank arm lengths are chosen so that, when both actuators are energized at the same time, the link (and therefore the support) is raised up three times that distance.

Therefore, using only two rotary actuators and a few mechanical linkages, it is possible to tilt the cartridge support and the cartridge thereon relative to the print head between four different positions just by selectively actuating the actuators. The actuators can be energized by a simple binary logic circuit controlled either by buttons on the printer keyboard or more preferably by the software controlling the printer per se. The apparatus for printing in color is comprised of only a relatively few inexpensive parts. Furthermore, those parts can be installed on or retrofitted to existing monochrome dot-matrix printers quite easily. Therefore, the present apparatus should find wide application in the color graphics industry.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENT

Figure 1:
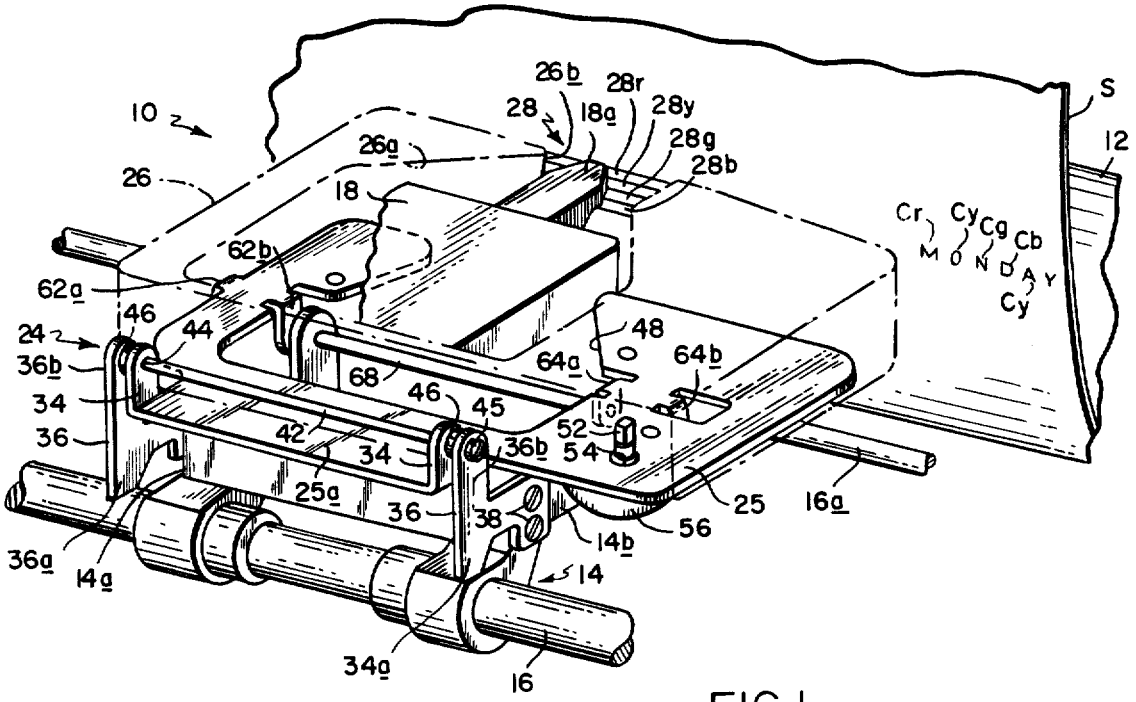
FIG. 1 is a fragmentary isometric view of a dot-matrix printer incorporating apparatus for color printing made in accordance with this invention.
Figure 2:
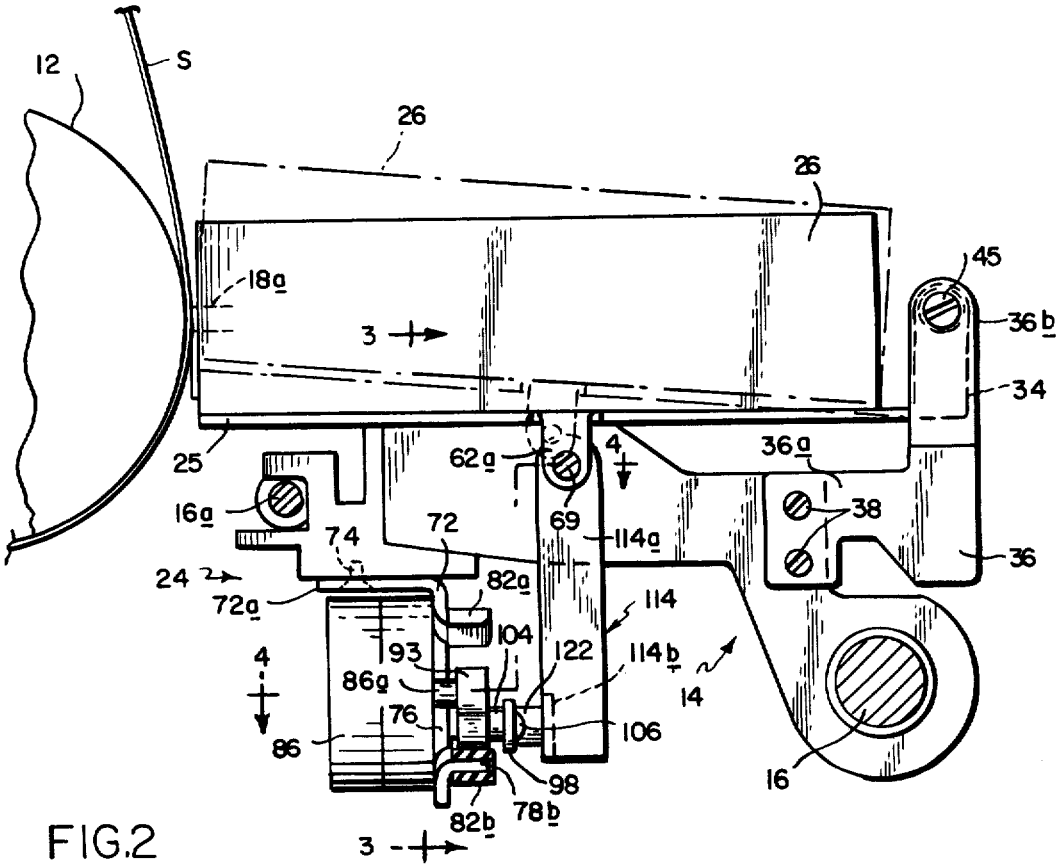
FIG. 2 is a fragmentary elevational view on a larger scale showing the apparatus in greater detail.

Referring to FIGS. 1 and 2 of the drawings, my printer 10 includes a cylindrical rotary platen 12 around which is engaged a printing medium such as a sheet of paper S. Positioned opposite the platen is a carriage shown generally at 14 which travels along guide rods 16 and 16*a* which extend parallel to platen 12. Mounted on carriage 14 is a dot matrix print head 18 whose working end 18*a* is located directly opposite platen 12 and the paper sheet S engaged thereon. Print head 18 is of the type having a vertical column of print wires which can be selectively actuated to project their ends from the print head end 18*a* toward platen 12. The illustrated head has seven print wires, although the invention can be practical with print heads having any number of such wires. Actually, the printer described thus far and the ancillary electrical and mechanical components for operating that printer are fully disclosed in the product and product literature offered by Digital Equipment Corporation of Maynard, Mass. under that company's designation LA-34 or LA-24 Printer. Therefore, the description and operation of those conventional printer parts need not be detailed here.

Also mounted to carriage 14 is my apparatus for color printing indicated generally at 24. This apparatus includes an ink ribbon cartridge support plate 25 on which is positioned a generally rectangular ribbon cartridge 26. Cartridge 26 contains a central opening 26*a* for accommodating the print head 18. Also, a gap 26*b* exists in the cartridge leading edge directly opposite the working end of the print head 18*a* facing platen 12. Cartridge 26 contains an ink ribbon 28 which initially is stored in loops or bights in the left hand section of cartridge 26. The ribbon extends through a slot in the cartridge leading edge at the left side of gap 26*b* and through a similar slot in the right side of that gap so that a working ribbon segment spans gap 26*b* as shown in FIG. 1 directly opposite the print head end 18*a*. The leading end of the ribbon is trained around a spool (not shown) inside the right hand section of the cartridge. When that spool is rotated in the clockwise direction, ribbon 28 is drawn across the cartridge gap 26*b* so that a fresh ribbon segment is presented to the print head at all times.

As best seen in FIG. 1, the ribbon 28 is composed of a plurality of different color horizontal bands. While any number of bands may be employed, the illustrated ribbon is divided into red, yellow, green and blue bands identified from the top down as $28_r$, $28_y$, $28_g$ and $28_b$. The ribbon 28 in cartridge 26 is one inch wide so that each color band thereon is one-quarter inch wide. The cartridge 26 itself is similar to the one utilized on the abovementioned DEC LA-34 monochrome printer except that it is twice as high. In other words, the standard cartridge is designed for one-half inch wide ribbon, whereas in the present color printer, the ribbon is one inch wide.

When the printer 10 operates, the carriage moves along guide rods 16 and 16*a* parallel to platen 12 while selected combinations of print wires in the printer 18 are driven against the ribbon 28 and the paper sheet S to form groups of dot columns which together form a line of characters on the paper. Simultaneously with the movement of the carriage 14, the color printing apparatus 24 tilts the plate 25 and the cartridge 26 supported thereon as required to properly position selected ink ribbon color bands opposite the print wires so that the indicia printed on the paper that form the characters are of the desired colors. As illustrated in FIG. 1, the characters C can be printed on sheet S in up to four colors identified by the subscripts r, y, g and b corresponding to the colors of the four ink ribbon bands. Of course, instead of the characters specifically illustrated, the dots created by the printer can form graphs, designs or other colored graphics.

Figure 3:
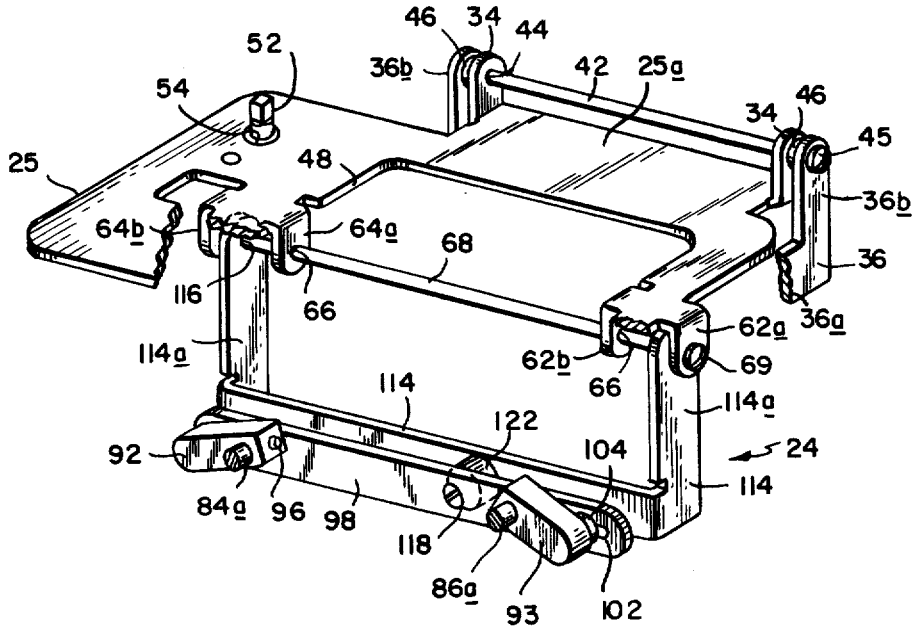
FIG. 3 is a sectional view along line 3—3 of FIG. 2.

Referring now to FIGS. 1 to 3, color printing apparatus 24 includes the support plate 25 which supports the ribbon cartridge 26. An edge margin 25*a* of that plate located more or less directly above the guide rod 16 has a reduced width and the opposite ends of that edge margin are bent to form a pair of upstanding ears 34 situated just inboard of the side edges 14*a* and 14*b* of carriage 14. Situated just outboard of the ears 34 are a pair of L-shaped brackets 36. The horizontal arms 36*a* of those brackets are connected by threaded fasteners 38 to the carriage sides 14*a* and 14*b*. The bracket vertical arms 36*b* extend up just outboard of the plate ears 34. An axle 42 extends through registering openings 44 in each ear and each bracket arm 36*b* so that the plate 25 can swing relative to the brackets 36. Desirably, bearings 46 are provided on the axle between each ear-bracket arm pair to facilitate such swinging motion. The axle 42 is held in place by shoulder screws 45 at its ends. Preferably, the axle 42 is aligned with the transverse medial plane of cartridge 26 so that, when plate 25 is tilted upward, the ribbon 28 will not bind on head end 18*a*.

As best seen in FIGS. 1 and 3, an opening 48 is provided in plate 25 to provide clearance for the print head 18 when the plate 25 swings on its axle 42. A spindle 52 projects up through an opening 54 into the underside of cartridge 26 where it engages the take-up spool inside the cartridge. The lower end of the spindle is connected to the output shaft of a one-way clutch 56 mounted to the underside of plate 25. The input shaft to the clutch is coupled by means (not shown) to the carriage drive so that the spindle 52 rotates clockwise to advance the exposed ribbon 28 segment past the print head only when the carriage 14 moves from left to right as shown in FIG. 1.

Plate 25 also has two laterally spaced-apart pairs of depending ears 62*a*, 62*b* and 64*a*, 64*b* at opposite sides of the plate, all of which ears are in lateral alignment midway between the front and rear edges of the plate. These ears contain an aligned series of lateral openings 66 for receiving an axle 68 which is held in place by shoulder screws 69 at its ends.

Figure 5:
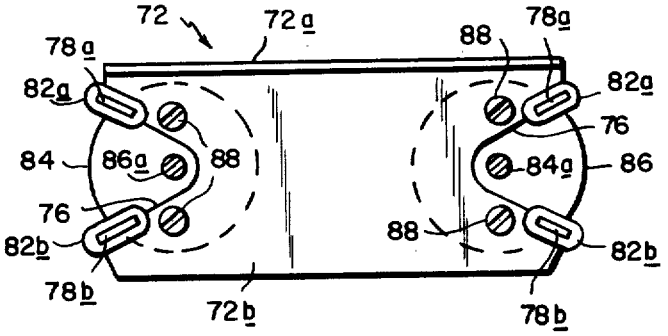
FIG. 5 is a sectional view along lin 5—5 of FIG. 4.

Referring now to FIGS. 2 and 5, a bracket 72 is mounted to the underside 14*c* of carriage 14 adjacent the leading edge margin thereof. Bracket 72 is generally L-shaped in cross-section having a horizontal arm 72*a* anchored to the carriage underside by threaded fasteners 74 (FIG. 2). The bracket vertical leg 72*b* extends down from the carriage in front of the plate ears 62*b* and 64*b*. That leg is formed with wedge-shaped cutouts 76 which extend in from its opposite side edges. Rearwardly extending upper and lower tabs 78*a* and 78*b* are formed at the upper and lower edges of each cutout 76 adjacent the mouth thereof. Engaged on each pair of these tabs are resilient sleeve-like upper and lower bumpers 82*a* and 82*b* to minimize vibration and noise when the apparatus is in operation.

Figure 4:
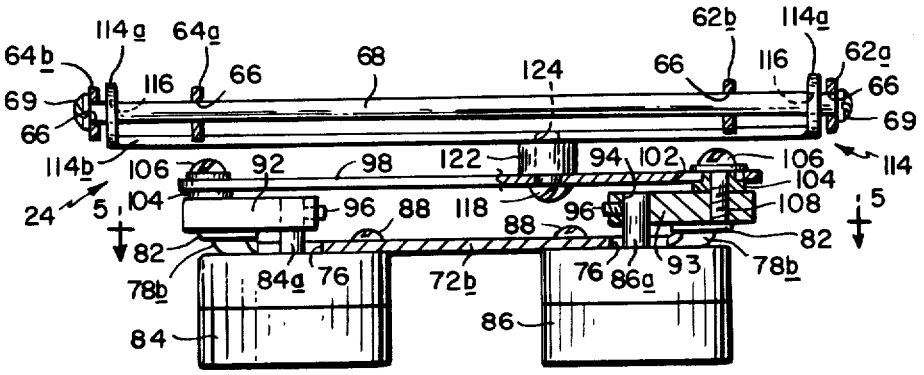
FIG. 4 is a sectional view along line 4—4 of FIG. 2.

Referring now to FIGS. 2, 4 and 5, a pair of rotary solenoids 84 and 86 are positioned against the front face of the bracket leg 72*b* with their shafts 84*a* and 86*a* projecting through the plate adjacent the roots of the cutouts 76. Each solenoid in achored to the bracket by threaded fasteners 88 which extend through the bracket leg and are turned down into the solenoid housing.

As best seen in FIGS. 3 and 4, a pair of substantially identical crank arms 92 and 93 are connected to the ends of the solenoid armatures 84*a* and 86*a* respectively projecting through the bracket leg 72*b*. More particularly, one end of each crank arm 92 and 93 contains a passage 94 which receives the associated armature. A set screw 96 is turned down into the adjacent end of the crank arm and penetrates into the armature, thereby locking each arm to its respective armature. The two crank arms extend away from one another and the free ends of the two arms are rotatively and slidably connected to the opposite ends of a relatively long rigid beam 98. That is, the opposite ends of the beam are provided with horizontal slots 102 through which project bushings 104 which bear against the crank arms 92, 93. A threaded fastener 106 extends through each bushing and is turned down into a threaded opening 108 formed in the free end of the adjacent crank arm. When the solenoids 84 and 86 are de-energized, their respective crank arms are slightly downwardly angled as shown in FIG. 3 and rest on the lower bumpers 82*b*. Furthermore, the lengthwise spacing between the beam slots 102 is such that, when the apparatus is in that reference position, the bushings 104 are located midway along their respective slots.

Turning now to FIG. 3, the beam 98 is pivotally connected to a generally U-shaped hanger 114. The spaced-apart arms 114*a* of the hanger are turned at right angles relative to the hanger bridging portion 114*b* which extends parallel to beam 98 directly behind that member. The hanger arms 114*a* project up between the pairs of ears 62*a*, 62*b* and 64*a*, 64*b* depending from opposite sides of plate 25. The upper end of each arm 114*a* is formed with a lateral opening 116 which receives axle 68 so that the hanger 114 can pivot on that axle. The beam 98 is pivotally connected to the hanger portion 114*b* by a threaded fastener 118 which extends through an opening in the beam, through a spacer bushing 122 positioned between the beam and the hanger and is turned down into a threaded opening 124 in the hanger portion 114*b*. Thus the beam 98 supports the plate 25 by way of the hanger 114 and axle 68. Furthermore, if beam 98 should be raised, the plate 25 will be tilted upwardly about the plate axle 42.

As best seen in FIGS. 3 and 4, instead of being centered on beam 98, the pivotal connection 118 between the beam and the hanger 114 is displaced toward the end of the beam opposite solenoid 86. More specifically, the distance between the beam-hanger pivot 118 and the pivotal connection 106 of the beam to the crank arm 93 is twice the distance between the fastener 118 and the pivotal connection of the beam to the crank arm 92. With this arrangement, by selectively energizing the solenoids 84 and 86, the plate 25 can be tilted upward through an angle that will position any one of the four ink ribbon color bands 28*r*, 28*y*, 28*g* and 28*b* opposite the working end 18*a* of the print head.

Figure 6D:
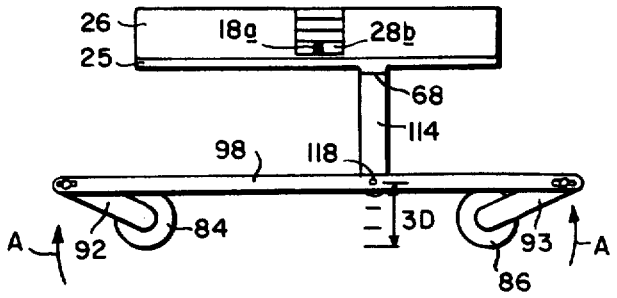
FIGS. 6A to D are diagrammatic views illustrating the operation of the FIG. 1 apparatus.
Figure 6C:
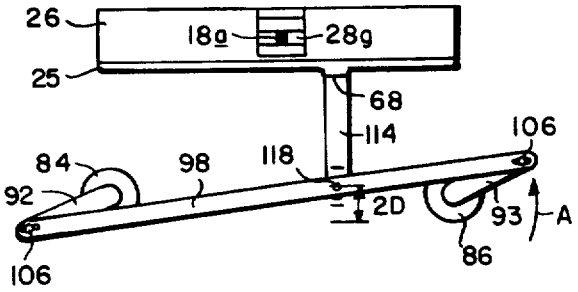
Figure 6B:
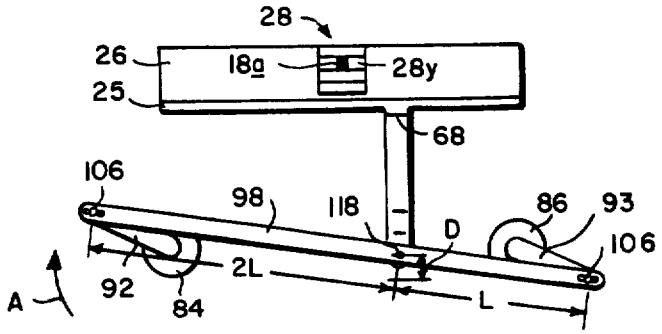
Figure 6A:
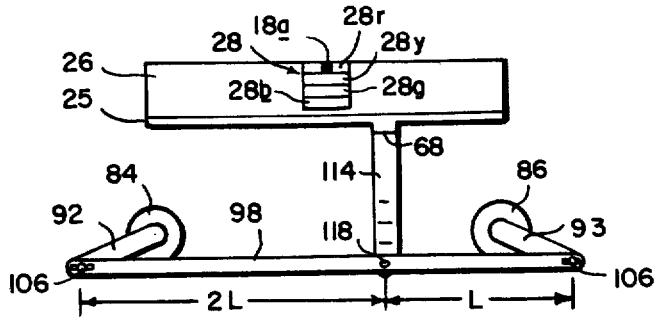

Turning now to FIGS. 6A, to 6D, during normal operation of the printer, when the solenoids 84 and 86 are both de-energized, their crank arms 92 and 93 rest on their lower bumpers 82*b* illustrated in FIG. 2. In this condition of the apparatus, the beam 98 is substantially horizontal and the beam, as well as its pivot 118, are in their lowest-most position illustrated in FIG. 6A.

Therefore, the cartridge support plate 25 and the cartridge 26 itself are not tilted at all relative to the print head 18. In this position of the cartridge, the ink ribbon 28 is in its lowest-most position which places the topmost color band 28*r* on the ribbon directly opposite the print head end 18*a*. That print head is illustrated in FIGS. 6A to 6D as a small black rectangle superimposed on the ribbon 28. Thus the next time the print head is actuated, the dots which it prints on sheet S (FIG. 1) will be colored red.

Assume, now, that one solenoid, say solenoid 84, is energized. This causes the solenoid armature and its crank arm 92 to rotate clockwise through a fixed angle A as illustrated in FIG. 6B so that the arm engages the associated upper bumper 82*a*. Such movement swings the end of the beam 98 attached to that crank arm upward about the beam's pivotal connection 106 to the crank arm 93 attached to the other solenoid 86. Resultantly, the beam functions as a class 2 lever, thereby raising the link pivot 118 and the link 114 and the leading edge of the cartridge support plate 25 to which the link is attached upward through a distance D. That distance D is substantially proportional to the product of the beam length L and angle A (in radians), the length L being the beam length between the pivot 118 and the crank arm 93 pivot 106. Those dimensions are selected so that the distance D is substantially equal to the width of each ink ribbon color band, i.e. one-quarter inch. Thus, when the leading edge of the cartridge support plate 25 is tilted up through that distance, the ribbon segment exposed at the leading edge of cartridge 26 is raised by that same distance relative to the print head end 18*a* so that the next lower ribbon color band 28*y* is disposed opposite the print head. Resultantly, the next time the print head is actuated, the dots which it prints on the paper sheet S (FIG. 1) will be colored yellow.

Turning now to FIG. 6C, if, on the other hand, the solenoid 86 should be actuated, its armature and the crank arm 93 attached thereto are rotated counterclockwise through the same angle A. Resultantly, the beam 98 is swung upward through the same angle A about its pivot 106 to the crank arm 92 attached to solenoid 84. Here again, the beam 98 acts as a lever thereby raising the pivot 118 and link 114. In this case, however, the lever arm between the pivot 118 and the crank arm 92 pivot 106 is 2L. In other words, the lever arm length is twice as long as was the case upon actuation of the solenoid 84 that was discussed in connection with FIG. 6B. Since, as noted previously, the distance by which the pivot 118 and link 114 are raised is directly proportional to that lever arm length, it is clear that the pivot 118 and the leading edge of the support plate 25 are raised upward through a distance 2D. Such movement tilts the leading edge of the cartridge 26 upwards by an amount which places the third ribbon color band 28*g* opposite the print head end 18*a* as shown in FIG. 6C. Consequently, the next time the print head is actuated, the dots which it prints will be colored green.

Finally, when both solenoids 84 and 86 are energized, both crank arms 92 and 93 are rotated upwards through the same angle A. This elevates the entire beam 98 and the leading edge of the support plate 25 to which it is attached vertically as shown in FIG. 6D. The crank arms 92 and 93 have the same length and that length is selected so that, upon actuation of both solenoids, the beam 98 is raised a distance equal to 3D. Resultantly, the exposed ribbon segment is raised by an amount which places its lowest-most color band 28*b* opposite the print head at 18*a* as shown in that figure. Consequently, when the printer next prints, the dots which it produces will be colored blue.

Thus, as the carriage moves from one printing position to the next, by appropriately energizing one or both or neither solenoid, the support plate 25 and cartridge 26 thereon can be tilted to move the exposed ribbon 28 segment vertically to present any of the four ribbon color bands to the print head end 18*a*. In this connection, we should mention that it is sometimes desirable to bias the plate 25 to its lowest or reference position. This may be done by means of a spring pulling downward on the pivotal connection 118 or by biasing the solenoid armatures to their reference positions.

Thus, using only two rotary solenoids, the apparatus is reliable and quite fast. Indeed, the selection of any of the four colors can be achieved in as little as 100 ms. Furthermore, it should be noted that the present apparatus for color printing can be incorporated into or retrofit to a conventional monochrome printer such as DEC's LA-34 or LA-24 printer. This simply involves attaching the apparatus by means of its brackets 36 and 72 to the carriage 14 of such a printer.

It should be noted also that the operation of the mechanism for shifting the cartridge 26 to print in different colors does not rely on motion of the carriage 14 or the means for driving that carriage. Consequently, unlike some prior printers discussed at the outset, the operation of the present apparatus has no effect at all on the prompt movement of the carriage along the platen 12 from one printing position to the next. Also, while we have shown the apparatus adapted to a dot matrix printer employing a ribbon cartridge, it can be used equally well with a printer such as a standard electric typewriter using fixed ribbon spools to enable that printer to print in a variety of different colors. This simply involves connecting the hanger 114 to the ribbon lifting guides usually found on that type printer so that the working segment of the ribbon is adjusted vertically.

Further, we have illustrated printing apparatus which can print up to four colors using rotary actuators in the form of solenoids each having only two different positions. The present apparatus can be modified easily to permit up to eight color selections by using a third rotary solenoid and crank arm mounted to beam 98 to raise and lower the hanger pivot 118 between two positions. In other words, for each position of that pivot, solenoids 84 and 86 can be actuated selectively as described to produce up to four color selections. It is also quite possible to extend the color range of the printer by using rotary actuators such as stepping motors which can be stepped between more than two positions. This would enable the link pivot 118 and cartridge support plate 25 to be raised to a number of different positions simply by appropriately selecting the step angles of the two rotary actuators. Of course, in these events, the ink ribbon 28 would have a number of color bands corresponding to the number of different possible positions of the cartridge support plate 25.

It will thus be seen that the objects set forth above, among those made apparent from the preceding description, are efficiently attained, and, since certain changes may be made in the above construction without departing from the scope of the invention, it is intended that all matter contained in the above description or shown in the accompanying drawings be interpreted as illustrative and not in a limiting sense.

It is also to be understood that the following claims are intended to cover all of the generic and specific features of the invention herein described.

What is claimed as new and desired to be secured by Letters Patent of the United States is:

1. Apparatus for color printing for installation in a printer having a platen, a carriage, printing means mounted on the carriage, means for moving the carriage along parallel to the platen and means for actuating the printing means so that the printing means can print on a printing medium engaged on the platen, said apparatus including A. means for supporting a cartridge containing an ink ribbon having at least four longitudinal bands of different colors disposed across the width of the ribbon between the printing means and the platen parallel to the platen so that, when actuated by the actuating means, the printing means prints indicia in a color corresponding to the one of the at least four ribbon segment color bands located opposite the printing means;

B. means for hinging the support means to the carriage at a location thereon distal to the platen so as to permit the support means to pivot on an axis lying parallel to the platen;

C. a rigid beam;

D. means for pivotally connecting said beam to the support means, said pivotal connection being located between the hinging means and the platen and displaced along the beam from the beam vertical centerline;

E. a first pivot connected adjacent to one end of the beam;

F. a second pivot connected adjacent to the other end of the beam;

G. means for maintaining the beam and support means in a reference position;

H. first means responsive to digital logic for lifting the first pivot from a lower position to at least one elevated position so that the beam is swung up about the second pivot thereby raising the support means a first selected distance above said reference position;

I. second means responsive to digital logic for lifting the second pivot from a lower position to at least one elevated position so that the beam is swung up about the first pivot thereby raising the support means a second distance above the reference position;

J. said beam and support means being lifted to a third selected position above the reference position when both said pivots are lifted to their at least one said elevated positions by said first and second lifting means, whereby the working edge of a ribbon cartridge positioned on the support means is moved vertically relative to the printing means so as to select one of the at least four different ribbon color bands for printing; and K. stop means engaged by the lifting means for defining the elevated positions of said lifting means.

2. The apparatus defined in claim 1 and further including means mounted to the beam for lifting said pivotal connection relative to the beam so as to double the possible positions of the support means when said pivots are lifted.

3. The apparatus defined in claim 1 and further including

A. a cartridge positioned on the support means, and

B. an ink ribbon contained in the cartridge, said ribbon having a plurality of longitudinal bands of different colors disposed across the width of the ribbon, the number of said bands corresponding to the number of different positions of the support means.

4. The apparatus defined in claim 1 wherein the first and second lifting means each comprise A. rotary actuating means having an armature and mounted to the carriage; and B. a crank arm having (1) one end connected to said armature, and (2) its other end coupled by a said pivot to a said beam end.

5. The apparatus defined in claim 4

A. wherein said actuating means are rotary actuators which, when energized, rotate their armatures through the same selected angles, and B. further including means for selectively energizing either or both of said solenoids.

6. The apparatus defined in claim 5 wherein the length of said beam between said pivotal connection and the first pivot is twice the beam length between the pivotal connection and the second pivot.

7. The apparatus defined in claim 1 wherein said hinging means pivot axis lies approximately in the transverse medial plane of a cartridge supported by the supporting means.

* * * * *